United States Patent [19]

Sowder et al.

[11] 4,329,926

[45] May 18, 1982

[54] BIASED SHEAVE FRAME FOR AERIAL TRAM

[76] Inventors: Tony R. Sowder; Douglas A. Sowder, both of E. 814 Grace Ave., Spokane, Wash. 99207

[21] Appl. No.: 149,443

[22] Filed: May 13, 1980

[51] Int. Cl.[3] ..... B61B 12/06

[52] U.S. Cl. ..... 104/179; 104/115; 104/173 R; 104/197

[58] Field of Search ..... 104/112, 115, 116, 125, 104/173 R, 173 ST, 178–180, 197; 200/61.13, 61.18

[56] References Cited

U.S. PATENT DOCUMENTS

| | | | |
|---|---|---|---|
| 2,709,966 | 6/1955 | Boynton et al. | 104/178 X |
| 3,347,172 | 10/1967 | Sowder | 104/178 X |
| 3,429,279 | 2/1969 | Pomagalski | 104/173 R |

FOREIGN PATENT DOCUMENTS

| | | | |
|---|---|---|---|
| 2140253 | 3/1972 | Fed. Rep. of Germany | 104/173 R |
| 1502590 | 3/1978 | United Kingdom | 200/61.18 |

*Primary Examiner*—Randolph A. Reese

*Attorney, Agent, or Firm*—Keith S. Bergman

[57] ABSTRACT

A compound frame to support a plurality of sheaves on a tower of an aerial tram with a predetermined bias between each sheave and a supported transiting cable. The sheaves are supported in paired opposed groups with each sheave of a group in substantial opposition so that the bias of each group of sheaves provides a safety factor to aid in maintaining a transiting cable therebetween. The manner of biasing paired sheave groups requires minimal forces for greater economy. An associated desheavement annunciating system is disclosed.

5 Claims, 9 Drawing Figures

BIASED SHEAVE FRAME FOR AERIAL TRAM

BACKGROUND OF INVENTION

RELATED APPLICATIONS

There are no applications related hereto heretofore filed in this or any foreign country.

FIELD OF INVENTION

Our invention relates generally to aerial trams having a single transiting cable and more particularly to a compound frame to support a plurality of groups of sheaves with bias against the transiting cable to aid in maintaining cable support.

DESCRIPTION OF PRIOR ART

Aerial trams of the type having a single endless transiting cable supported above the ground along a particular course by spaced towers commonly provide support for the transiting cable on the spaced towers by means of plural sheaves. In the present day art a set of cable supporting sheaves are commonly divided into groups of at least two sheaves arranged on opposite sides of the supported cable and generally positioned so that a line through the centers of the opposed sheaves would be substantially parallel to forces existing between the supported cable and sheaves. A support group may comprise two or more sheaves and a set of at least two such support groups is commonly associated with each cable support position on a tower.

The endless single transiting cable trams are commonly used in the present day to transport skiers in areas of extreme environmental conditions. Safety has always been a primary concern of such transport but in recent times it has been of even increased importance. Responsively various sophisticated cable support systems such as that described have come into common use as have associated cable desheavement sensing systems that may annunciate a desheavement condition, stop tram activity or both. In the recent past the general concern for tram safety has been reflected by legislation giving rise to various safety codes. At least one of these safety codes requires a biasing force of at least one hundred pounds to be exerted by a supporting sheave against its supported cable at all times, and it appears quite possible that this or a similar provision will be incorporated in other safety codes. The instant invention seeks to provide a biasing sheave supporting structure to fulfill this requirement and yet allow use of various sophisticated multiple sheave support systems and desheavement sensing systems heretofore existant, all at a minimum cost.

In providing such a biased support system it is to be remembered that the force between supported transiting cable and supporting sheaves need not be vertical, often is not, and even if vertical may be either up or down. Again, the amount of this load and its direction may change during tram operation responsively to various parameters such as load, operating conditions and environmental conditions. To be most efficient and operable a biasing system must take all of these various factors into account in its operation, it must respond instantaneously to changes in condition and it should, to promote economy, exert as nearly as possible no more than the biasing force required. The instant invention provides a particular structure to accomplish these ends.

The prior art relating to this field of endeavor has heretofore either purposefully or accidentally provided individual sheaves supporting or contacting a transiting cable with some predetermined bias. The instant invention is distinguished from this class of prior art in that it provides a support that biases opposed, cooperating pairs of sheaves toward each other with a predetermined bias between either sheave of a pair and supported cable and an interconnection between sheaves so that the total force between sheaves is the force between either sheave and the cable. This type of structure allows the cable to change from support by one sheave to support by the opposed sheave while either of the operating sheaves maintains the required minimal bias on the supported cable but yet the total biasing force exerted between sheaves remains constant. This function is accomplished by movably supporting the opposed sheaves of a group relative each other with a common mechanical biasing force therebetween. The instant invention thusly differs in both structure and function from this class of prior art.

Another class of similar prior art has provided a set of plural supporting sheaves in groups arranged on opposite sides of the cable but with sheave axles rigidly mounted relative to a common support so that the force exerted by the sheaves on a transiting cable is fixed and cannot and does not change responsively to cable positions and operating conditions. This class of device is, again, distinguishable from the instant invention both structurally and functionally in that in the instant invention sheaves can and do move responsively to cable position and operating conditions and can and do change the force exerted upon the cable responsive to those conditions while yet maintaining a minimal bias on the cable and a minimal biasing force between the sheaves.

SUMMARY OF THE INVENTION

Our invention generally provides a compound mounting for a set of groups of opposed cooperating sheaves to support a traction cable of an aerial tram therebetween with a predetermined minimum force between each sheave and the supporting cable.

We provide a medial sheave frame body, having means for attachment to a supporting tower, with two pivotably mounted substantially co-planar sheave support arms extending laterally on each side of the body, so positioned that the ends of the arms on each side are spaced vertically from each other. The end parts of each of the support arms provide axles for mounting a pair of cooperating sheaves to carry a traction cable therebetween. Spring biasing means communicate between each cooperating group of support arms to bias these arms toward each other to create the desired force between cable and sheaves. Motion limiting stops are provided on each side of both the upper and lower portions of the body to limit the motion of the support arms toward the body to a predetermined position.

Elongate yokes communicate between cooperating groups of support arms to allow their motion relative to each other and to cooperate with an associated sensing system to sense cable desheavement and to annunciate this event.

In creating such a device it is:

A principal object of our invention to create a compound biased sheave frame that will maintain opposed cooperating members of a group of sheaves supporting a traction cable of an aerial tram with a minimal predetermined force against the traction cable.

A further object of our invention to provide such a device that maintains required bias between each member of a cooperating sheave group and a supported cable with a minimal total force between sheave members to require no heavier construction than necessary for the device.

A further object of our invention to provide such a device that positionally maintains a transiting cable during operative changes of load.

A still further object of our invention to provide such a device that complies with modern day safety codes requiring minimal bias of supporting sheaves against supported transiting cable and is yet compatible with most existing tram systems, including present day rope desheavement sensing and other safety systems.

A still further object of our invention to provide such a device with an associated system to sense and annunciate traction cable desheavement.

A still further object of our invention to provide such a device that is a new and novel design, or rugged and durable nature, of simple and economic manufacture and one otherwise well suited to the uses and purposes for which it is intended.

Other and further objects will appear from the following specifications and accompanying drawings which form a part hereof. In carrying out the objects of our invention, however, it is to be understood that its essential features are susceptible of change in design and structural arrangement with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

Our invention comprises generally body 10 pivotably mounting paired, cooperating support arms 11 extending laterally on each side therefrom with biasing means 12 between each cooperating group of support arms and motion limiting devices 13 associated therewith to allow but limit motion of the support arms relative to each other and relative to the body.

Figure 2:
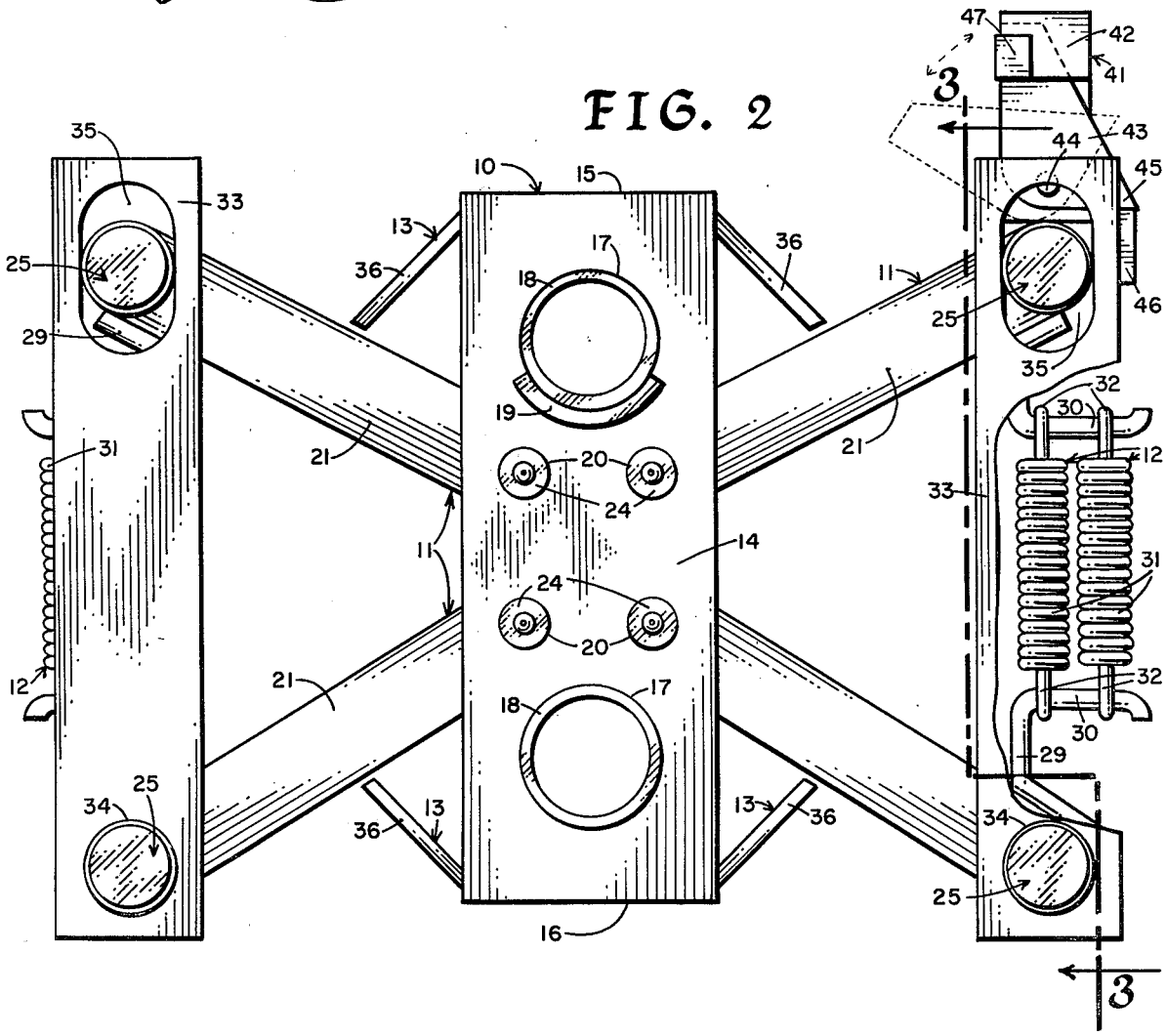
FIG. 2 is a partially cut-away, orthographic, vertical side view of the sheave support frame of our invention with sheaves removed therefrom to better show its several parts, their configuration and relationship.
Figure 7:
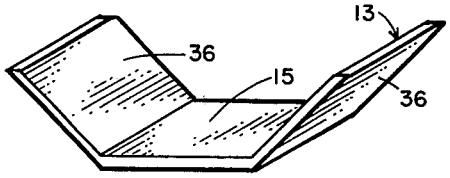
FIG. 7 is an isometric view of one of the body supported stops that limit sheave support arm motion.
Figure 9:
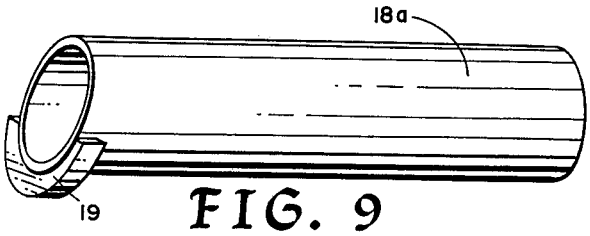
FIG. 9 is an isometric view of an upper tower shaft support sleeve.
Figure 8:
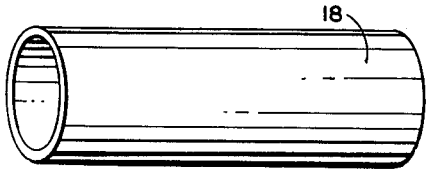
FIG. 8 is an isometric view of a lower tower shaft support sleeve.
Figure 3:
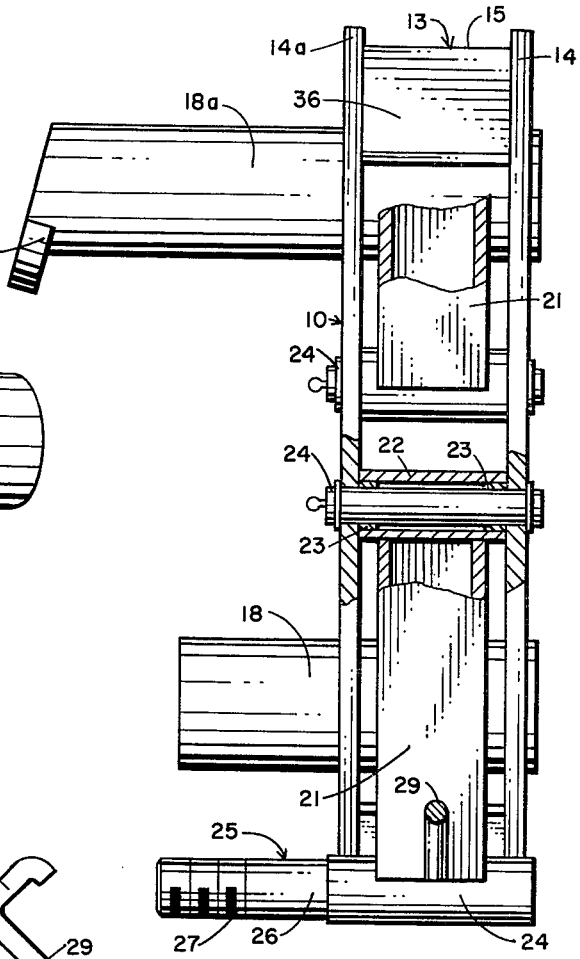
FIG. 3 is a partially cut-away, orthographic, vertical end view of the sheave support shown in FIG. 2 looking at the right end of the device as it appears in FIG. 2.
Figure 4:
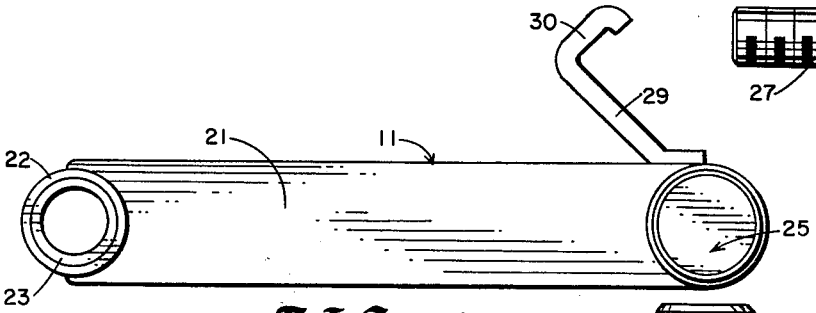
FIG. 4 is an orthographic side view of one of the sheave support arms of our invention.
Figure 5:
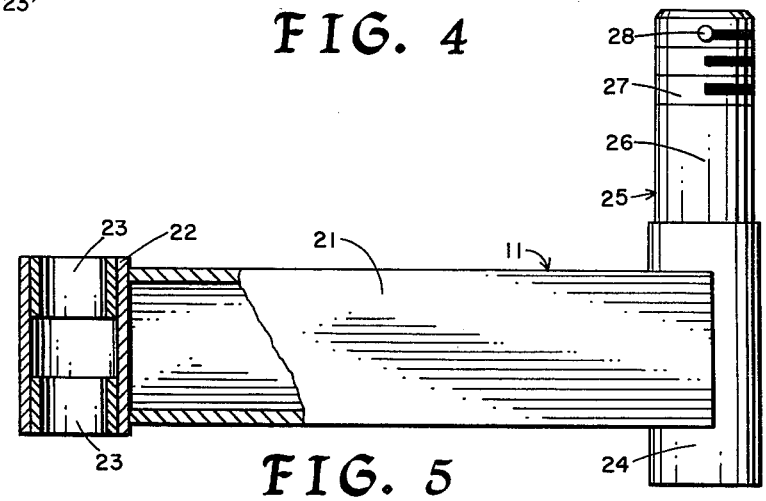
FIG. 5 is a partially cut-away top or plan view of the support arms of FIG. 4.
Figure 6:
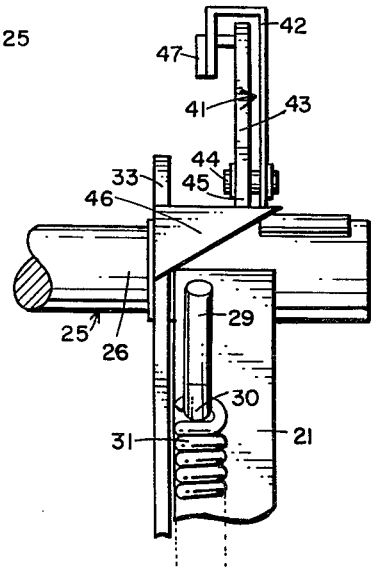
FIG. 6 is a partial orthographic end view of the upper part of the right support arm structure of FIG. 2 showing particularly the cable desheavement sensing structure.

Body 10 as seen particularly in FIGS. 2 and 3 is formed by two similar sheet-like side elements 14, **14*a* structurally joined in a spaced relationship by top element 15 and bottom element 16 to form the rigid, four sided box-like structure illustrated. Cooperating upper and lower support shaft sleeve holes 17 are defined in side elements 14 to receive cylindrical support shaft sleeves 18, 18*a* with their axis substantially normal to the longer areal surface of the side elements. The tower shaft sleeves normally project some distance laterally of side element 14*a* adjacent the traction cable to be supported and upper sleeve 18*a* commonly will be provided with cable catcher 19 in its outer end part to tend to aid positional maintenance of a desheaved cable. Only one sleeve 18, 18*a* is mounted on a tower at one time but two sleeves are provided to allow variable positioning of our invention relative to a supporting tower. The medial portions of side elements 14, 14*a* each define a set of four spindle support holes 20 arranged in cooperating vertical pairs to receive cylindrical spindle supports therebetween, perpendicularly to side elements 14, 14*a***.

Sheave support arms 11 are elongate, rigid elements of rectilinear cross-section in the form illustrated, generally formed from rectangular channel of commerce. Their dimension perpendicular to the plane of projection of FIG. 2, which for convenience will be called thickness, is very slightly less than the distance between the inner facing surfaces of body side elements 14, **14*a*. The inner or body communicating end of each support arm provides cylindrical bearing support 22, preferably formed of pipe, mechanically attached to channel 21 by welding. This bearing support is provided in each end part with two bushing type bearings 23 generally positionally maintained by a press fit. The axial dimension of the bearing support is substantially the same as the distance between the adjacent facing surfaces of side elements 23 so that the bearing support may pass therebetween when oriented perpendicularly thereto. Each bearing support is provided with a solid, cylindrical, arm support spindle 24 of appropriate diameter to provide a pivotable fit within bearings 23 and of a length somewhat greater than bearing support 22 so that the spindle will extend through a pair of cooperating spindle support holes in side elements 14** with enough projection on each outer side of the side elements to allow fastening as by welding for positional maintenance in the spindle holes to pivotably mount each support arm to the body.

The outer end parts of each sheave support arm are provided with similar sheave spindles 25 each comprising an elongate, cylindrical structure having medial bearing portion 26 and threaded end portion 27 to mount a sheave for rotation laterally of the support arm. The sheave spindles are mechanically attached to the support arms preferably by welding. A sheave is positionally maintained for rotation on bearing portion 26 by a nut (not shown), threadedly engaged on threaded end portion 27 and maintained for safety commonly by a kotter key (not shown) extending through key hole 28 in the outer end part of the bearing portion, all according to the common custom of mounting such sheaves in the existing art.

The outer or sheave supporting ends of each cooperating pair of sheave support arms on their adjacent facing surfaces are provided with rigid spring arms 29 mechanically attached to the support arms, again preferably by welding. These spring arms are generally formed from rod stock to the modified "J" form illustrated particularly in the drawing of FIG. 2 so that, when assembled, legs 30 of the cooperating pair of spring arms will be substantially parallel.

If channel element 21 from which support arms 11 are formed be of square cross-sectional configuration, all of the support arms will be similarly formed. If, however, the channel be of rectilinear cross-section, the upper two arms will necessarily have to be mirror images of the lower two arms so that when formed and assembled all sheave spindles 25 will project in the same direction as illustrated in FIG. 2.

Biasing means 12 comprise extension springs 31 each having end loops 32 for attachment to legs 30 of a pair of cooperating spring arms 29, again, as illustrated in FIG. 2. Commonly, for mechanical convenience and in view of the particular parameters of commercially available springs, two similar extension springs will be used between each cooperating set of sheave support arms though obviously a single spring, a plurality of springs or other similar mechanical biasing means might fulfill the same purpose. These springs will exert the predetermined safety tension force desired for the device, commonly one hundred pounds, between cooperating pairs of support arms when they are in a position to mount paired opposed cooperating sheaves with a traction cable carried therebetween.

Motion limiting devices 13 comprising body stops 36 limit the motion of support arms 11 toward body 10 as illustrated in FIG. 2. Two such stops are carried by bottom 16 and two similar stops are carried by top 15 of the body. The lower stops angle laterally outwardly and upwardly and the upper stops angle laterally outwardly and downwardly, each to limit the motion of the immediately adjacent support arm toward the body. Commonly stop arms 36 will be formed as an integral part of top and bottom body elements 15, 16 though not necessarily so. These body stops are so positioned and spaced that when a cooperating pair of support arms extend pivotably away from each other a distance sufficient to mount paired cooperating sheaves thereon with a traction cable therebetween the stops would permit a slightly greater pivotable motion of the associated support arm. This structure allows the biasing springs to be operative to maintain a safety biasing force but also allow any further load to be carried by the sheave body. Two similar stop plates 33 are associated with each cooperating pair of support arms. Each stop plate is an elongate linear bar defining in its lower end portion circular lower sheave spindle hole 34 of a diameter that will fit about sheave spindle 25. In its upper part it defines elongate upper sheave spindle slot 35 formed with semi-circular ends joined by straight lines and with a width substantially the same as the diameter of sheave spindle 25 to allow a sliding motion of a sheave spindle therein. Spindle hole 34 and slot 35 are spaced to allow motion of a pair of associated support arms away from each other to the maximum permitted by body stops 36 and to allow their motion toward each other to at least as close as the paired cooperating sheaves supported thereon would allow if they were supporting no transiting cable between them. This dimensioning can be readily defined by ordinary engineering methods.

Stop plates 33 serve primarily to provide a derail system 41 to sense and annuciate traction cable desheavement. This derail system provides body 42 rigidly mounted on the upper part of upper sheave spindle 25 to extend vertically upwardly therefrom. Body 42 pivotably mounts sensing arm 43 by axle 44 extending therebetween. The sensing arm is somewhat triangularly shaped or as indicated with a lateral portion 45 extending some distance laterally from the axle 44. Switch dog 46 is carried by the upper part of stop plate 33 in a position to contact the lower portion of sensing arm 43, at some distance from its pivot when the associated cooperating pair of sheaves support a transiting cable therebetween. Position sensitive switch 47 senses the position of sensing arm 43 relative to body 42 and through well known circuitry (not shown) annunciates a changed condition. With this structure then if the transiting cable becomes desheaved, the cooperating pair of sheaves previously supporting it will move closer together because of the bias of springs 31 and upper sheave spindle 25 will move closer to the lower sheave spindle thus causing switch dog 46 to pivot sensing arm 43 and cause switch 47 to annunciate the condition. Preferably the derail system will be on the incoming cable side of multiple groups of support sheaves.

All of the parts of our invention are formed from metal to provide appropriate rigidity and strength. Commonly mechanical joinder will be accomplished by welding except where as otherwise indicated to the contrary. The various surfaces that move relative to each other are preferably provided with lubrication means heretofore well known in the mechanical arts.

Having thusly described our invention its operation may be understood.

Figure 1:
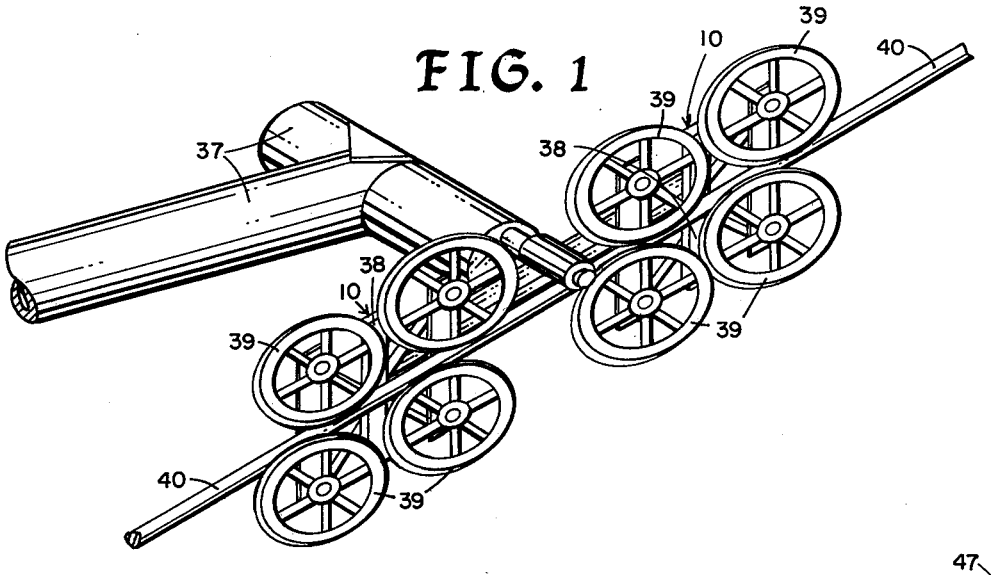
FIG. 1 is an isometric view of a portion of a tower carrying our invention to support a set of sheaves which in turn support a portion of a transiting traction cable of an aerial tram, showing generally the relationship of these various elements.

Firstly, secondary sheave support frames are formed according to the foregoing specification and as illustrated particularly in FIGS. 1 and 2 of the drawings. The parameters of the devices are appropriately adjusted so that each sheave supported thereby will exert at all times a pre-determined minimal force upon a supported transiting cable. Commonly in the present day practice this force will be one hundred pounds to meet existing legislated safety standards.

As illustrated particularly in FIG. 1 our invention will commonly be supported on upper part 37 of a tower by primary sheave frame 38 which in turn supports two similar secondary biased sheave support frames of our invention. Commonly primary sheave frame 38 will be pivotably mounted on the tower and it, again, will pivotably mount the secondary sheave frames of our invention by means of primary frame shafts (not shown) supported in support shaft sleeves 18. This pivotal mounting of primary or secondary sheave frames is commonly used in the present day tram arts to even cable load on sheaves and our sheave frames are compatible with it.

Our assembled invention is positioned on the primary sheave frame as aforesaid and similar sheaves 39 having internal bearings are mounted on sheave spindles 25. The sheaves are appropriately dimensioned so that transiting cable 40 is supported between two sheaves of a vertically opposed, cooperating group. The parameters of our invention have been previously adjusted as specified so that in such position each sheave of the cooperating group will exert the minimum required safety force upon the traction cable supported therebetween. If the transiting cable becomes desheaved from between a cooperating pair of supporting sheaves, the sheaves will move toward each other to ultimately activate the desheavement switch 47, as described, to annunciate the happening.

The load of the cable on the sheave group commonly will be vertically downward and supported by the lower sheaves of a set, but it well may be upward or supported by any combination of sheaves depending upon the nature of the load. It is to be noted that an external load on any particular sheave will cause support arm 11 supporting that sheave to move toward body 10 to be limited in its motion by an associated body stop 36 and the load thusly supported by body 10 and ultimately through the primary sheave frame by tower 37. During this support, however, all non-load biasing supporting sheaves will still exert the minimum safety force upon the supported transiting cable and should the load change the device will instantaneously respond to change its support but yet always maintain the minimal safety force between each sheave and the transiting cable.

It is to be particularly noted from the foregoing description that no more than a minimum safety loading force will be exerted between the opposed cooperating pairs of any sheave group to allow a minimal total force on the structure and thusly to allow the structure to be as light as possible while yet maintaining the appropriate safety biasing.

The foregoing description of our invention is necessarily of a detailed nature so that a specific embodiment of it might be set forth as required but it is to be understood that various modifications of detail, rearrangement and multiplication of parts may be resorted to without departing from its spirit, essence or scope.

Having thusly described our invention, what we desire to protect by Letters Patent, and

What we claim is:

1. In a compound frame for support of a group of sheaves which in turn support the transiting cable of an aerial tramway with a predetermined safety force between each sheave of the group and the supported transiting cable, the combination comprising:

a body having means for mounting on a supporting structure;

paired, opposed support arms pivotably supported by the body in angular relationship with each other, each support arm having in its outer portion a sheave spindle to mount sheaves to support a transiting cable therebetween;

mechanical biasing means communicating between the support arms to bias them toward each other with a predetermined minimum force; and means of limiting the motion of each support arm toward the body.

2. The invention of claim 1 further characterized by:

a stop plate connecting sheave spindles and having a slot to accept one sheave spindle to allow limited motion of the sheave spindles relative each other;

a derail system, associated with the stop plate and sheave spindle carried in the slot of the stop plate, having means to sense position of the sheave spindle in the stop plate slot to determine cable desheavement; and means to annunciate cable desheavement.

3. The invention of claim 1 further characterized by:

a stop plate connecting sheave spindles and having a slot to accept one sheave spindle to allow limited motion of the sheave spindles relative each other;

a derail system, associated with the stop plate and sheave spindle carried in the slot of the stop plate, comprising:

a body carried by the sheave spindle to extend upwardly therefrom;

a sensing arm carried by the body for pivotal motion;

a switch dog carried by the stop plate and positioned to pivot the sensing arm only if the sheave spindle carrying the body moves toward the other sheave spindle closer than the two spindles are when a transiting cable is carried between cable support sheaves carried by said sheave spindles; and a position sensing switch to annunciate the pivotal motion of the sensing arm.

4. A compound frame for support of a set of two groups of vertically related sheaves which in turn support a transiting cable of an aerial tramway with a predetermined safety force between each sheave of a group and the supported traction cable, comprising, in combination:

a body having means for pivotable mounting on a support structure;

four rigid support arms pivotably supported in the medial portion of the body with two support arms extending laterally therefrom in angularly related cooperating pairs on each side of the body, each support arm having in its outer portion a sheave spindle extending therefrom to pivotably mount a cable supporting sheave laterally adjacent thereto, with all sheaves substantially co-planar, to support a transiting cable between sheaves of a support arm group;

mechanical biasing means extending between each cooperating pair of support arms biasing them toward each other with a pre-determined safety force; and means limiting the motion of any support arm toward the body comprising stop arms carried by upper and lower portions of the body to extend laterally therefrom on both sides of the body.

5. The invention of claim 4 further characterized by:

similar stop plates connecting sheave spindles of each cooperating group of support arms, each stop plate having a slot to accept one sheave spindle to allow limited motion of the sheave spindles relative to each other;

at least one derail system, associated with at least one stop plate and sheave spindle carried in the slot of that stop plate, said derail system having means to sense position of the sheave spindle in its associated stop plate slot to determine cable desheavement.

* * * * *